US006869323B2

(12) United States Patent
Norman

(10) Patent No.: US 6,869,323 B2
(45) Date of Patent: Mar. 22, 2005

(54) PEDAL POWERED WATERCRAFT AND EQUIPMENT

(76) Inventor: Larry Norman, 2292 W. Lake Rd., Clio, MI (US) 48240

( * ) Notice: Subject to any disclaimer, the term of this patent is extended or adjusted under 35 U.S.C. 154(b) by 0 days.

(21) Appl. No.: 10/636,445

(22) Filed: Aug. 7, 2003

(65) Prior Publication Data

US 2004/0087225 A1 May 6, 2004

Related U.S. Application Data

(60) Provisional application No. 60/401,874, filed on Aug. 8, 2002.

(51) Int. Cl.[7] ..... B63H 16/20
(52) U.S. Cl. ..... 440/28; 440/21
(58) Field of Search ..... 441/21, 26, 27, 441/28, 29, 30, 31

(56) References Cited

U.S. PATENT DOCUMENTS 1,920,391 A * 8/1933 Herwig ..... 440/30
5,626,501 A * 5/1997 He ..... 440/30

FOREIGN PATENT DOCUMENTS

WO WO 9400339 * 1/1994

* cited by examiner

*Primary Examiner*—Jesus D. Sotelo
(74) *Attorney, Agent, or Firm*—The Weintraub Group, P.L.C.

(57) ABSTRACT

A water driven pedalcraft in which water propelling blades or paddles and a drive mechanism for driving the blades or paddles are associated with a framing system removably mounted atop a buoyant pontoon system. The drive mechanism preferably comprises conventional parts of a bicycle that are operably coupled to flexible and rigid drive shafts, or drive belts, which mechanism transmits torque to drive the water engaging paddle or propeller blades. The pontoon system includes a forward pontoon and a rearward pontoon, the pontoons being movable from a first position, wherein the pontoons are "in-line" with one another, and into a second position, wherein the pontoons are at an angle to one another, when the user desires to steer the watercraft into another direction.

22 Claims, 6 Drawing Sheets

FIG 2A
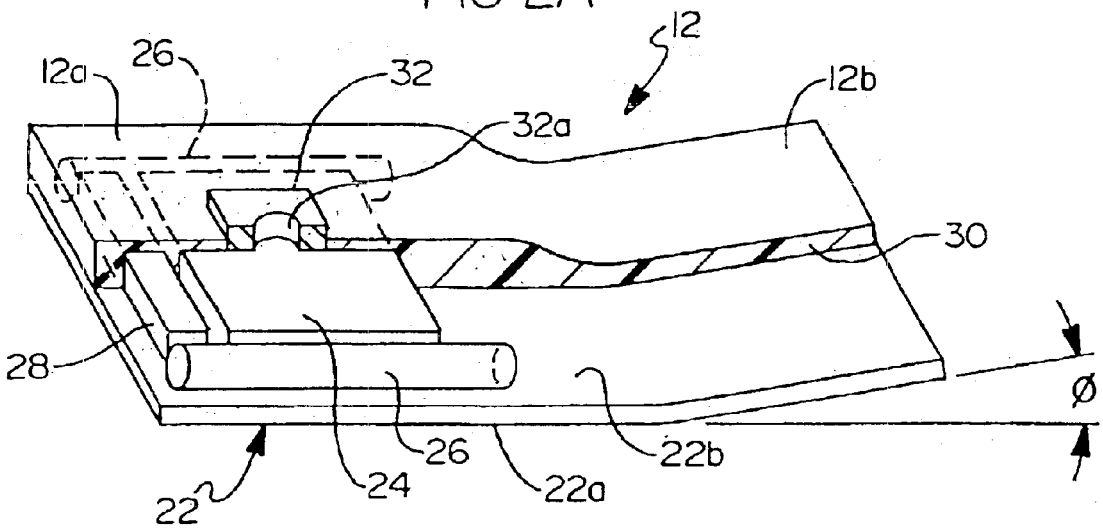
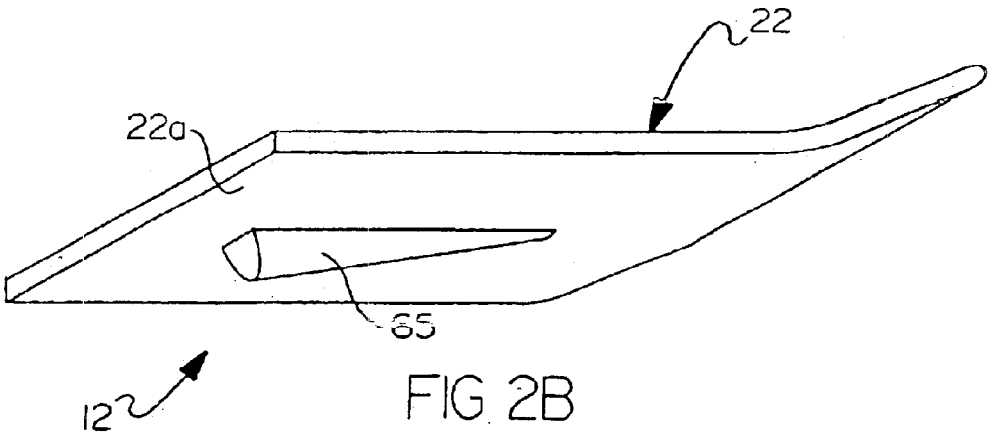
FIG 2B

FIG 3
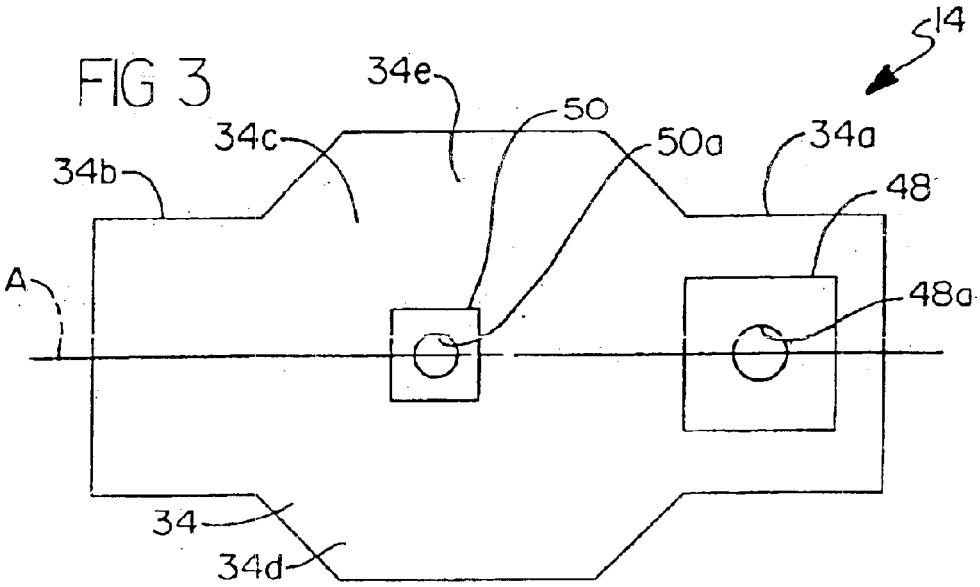
FIG 4
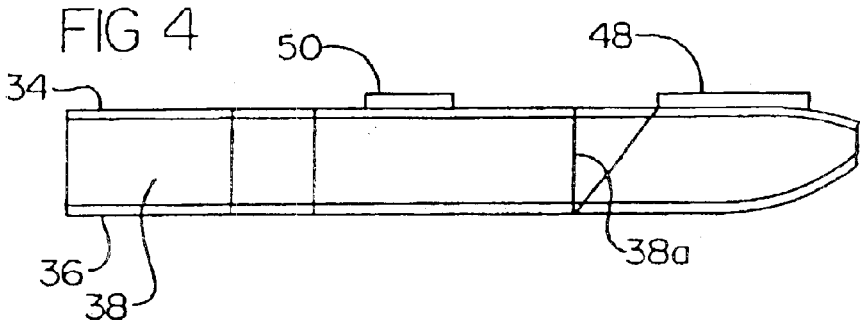
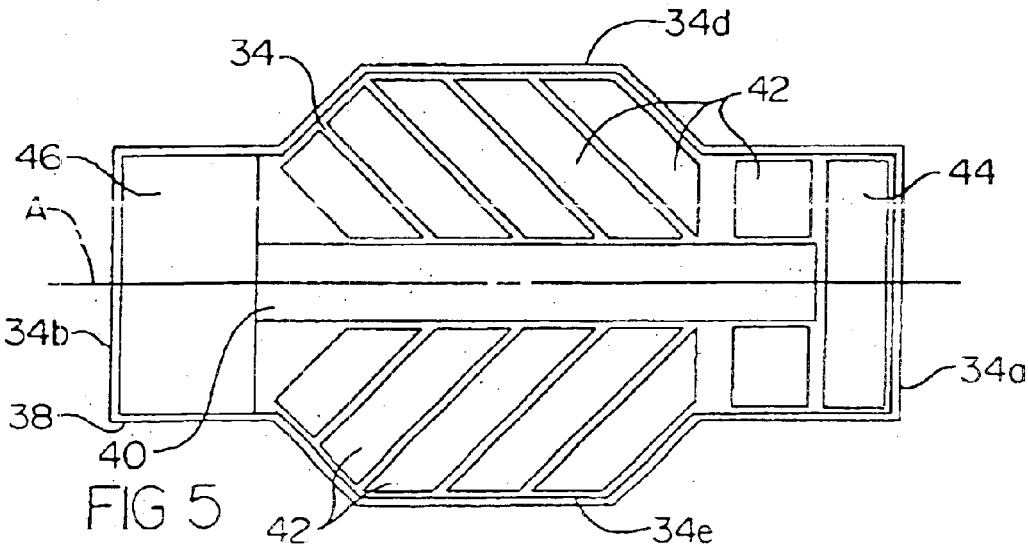
FIG 5

FIG 9A
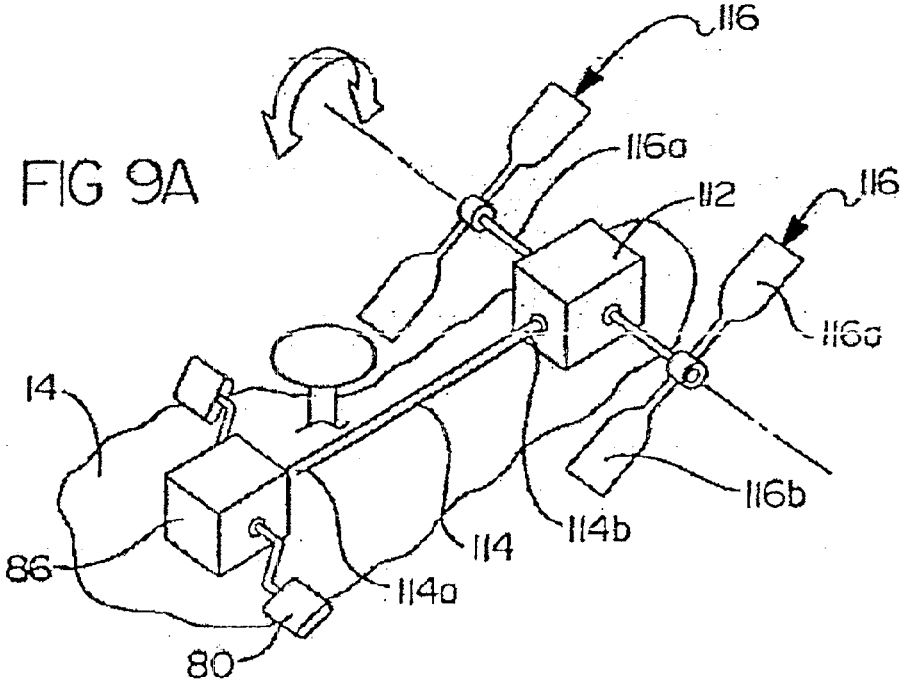
FIG 9B
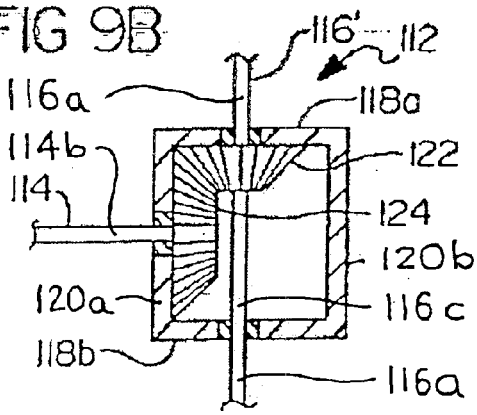
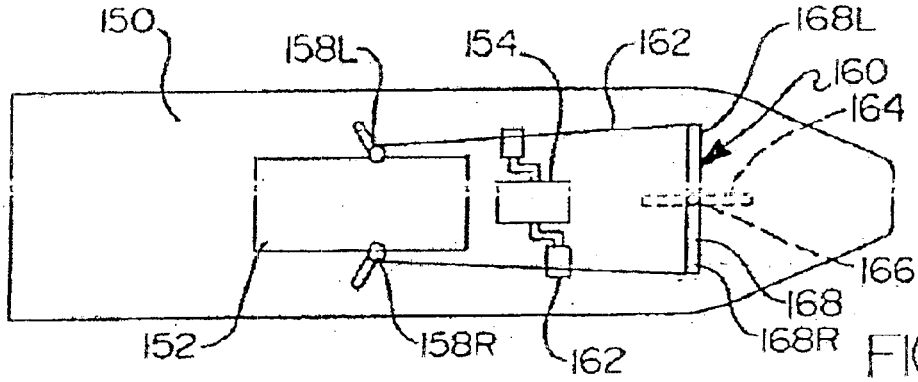
FIG 13B

FIG 10
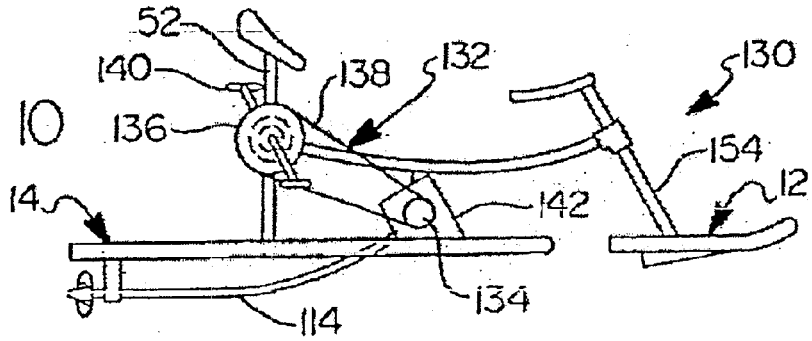
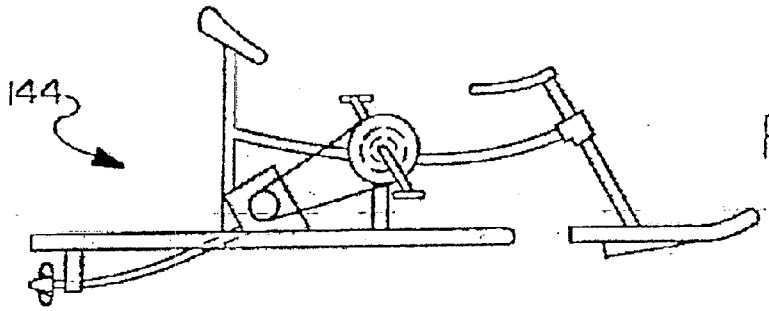
FIG 11
FIG 12
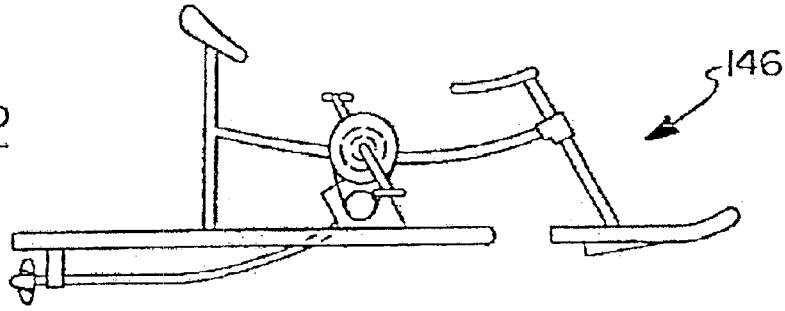
FIG 13A
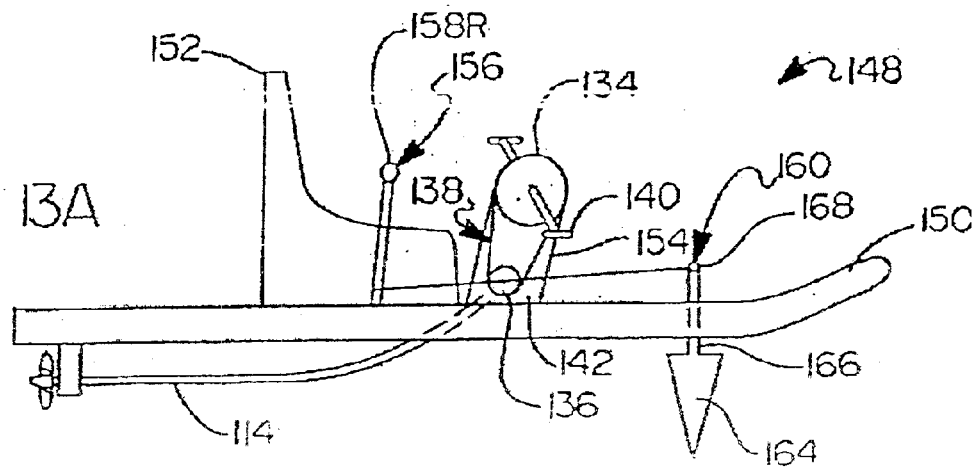

PEDAL POWERED WATERCRAFT AND EQUIPMENT

CROSS-REFERENCE TO RELATED APPLICATION

This application claims the benefit of U.S. Provisioanl Application Ser. No. 60/401,874, filed Aug. 8, 2002, the entire disclosure of which is hereby incorporated by reference.

BACKGROUND OF THE INVENTION

This invention relates generally to flotation craft and equipment for use on the water, which is pedal powered by the user in the manner of a conventional bicycle.

Paddle propulsion devices for movement on the water are known, as exemplified by steamboats. In such watercraft, a large cylindrical drum is provided with paddles arranged horizontally about the circumference of the drum and in parallel relation to an axis of rotation through the drum. Rotation of the drum brings the paddles into engagement with the water to propel the watercraft.

Pedal driven apparatus in the form of a bicycle or health equipment are well known and for their ability to provide transportation and use in exercise. Conventionally, the bicycle includes forward and rearward frame portions for supporting a respective wheel and for steering and supporting the user, and a pedal mechanism connected to the rearward frame portion for propelling the bicycle.

Similarly, pedal driven health equipment enables the user to increase cardiovascular strength. Such equipment is similar to a bicycle in that the user grips handlebars, and pedals a wheel-like member to simulate the effect of driving on a real bicycle. Resistance to wheel rotation can be adjusted as desired to increase the pedaling effort required by the user, and thus more accurately simulate the experience of riding a bicycle on the streets and also to cause more calories to be burned.

Oftentimes in remote locations, an individual must go around or across a body of water, such as a river or small lake, to reach a desired point. Sometimes water crossing is for recreational purposes or exercise. In many situations, rapid crossing of a body of water may be a matter of medical emergency.

While motorized watercraft are known, such as exemplified by motorboats, these craft are expensive—either to purchase or to maintain. An inexpensive watercraft that is easy to maintain and enables a user to cross a body of water would be desirable.

SUMMARY OF THE INVENTION

The primary object of this invention is the provision of a watercraft having a simple and practical propulsion apparatus, which operates simply and efficiently.

According to the objects and advantages of this invention is the provision of watercraft, or pedal driven flotation apparatus, which may be propelled by a user across a body of water.

To achieve the objects and advantages of this invention there is provided herein a water driven propulsion device in which water propelling blades or paddles and a drive mechanism for driving the blades or paddles associated with a framing system removably mounted atop a buoyant pontoon system. The drive mechanism preferably comprises conventional parts of a bicycle that are operably coupled to an endless drive chain, a drive shaft, or drive belts, which drive the water-engaging paddle or propeller blades. The pontoon system includes a forward pontoon and a rearward pontoon, the pontoons being movable from a first position, wherein the pontoons are "in-line" with one another, and into a second position, wherein the pontoons are at an angle to one another, when the user desires to steer the watercraft into another direction.

More particularly, the objects of this invention are attained by an amphibious watercraft, the watercraft including:

a forward and a rearward pontoon, each pontoon being generally planar, longitudinally elongated, and sufficiently buoyant to support the watercraft and rider on a body of water, means for mounting the pontoons together in axially spaced relation to one another and such that the pontoons define a generally horizontally disposed plane for engaging the water and are angularly positionable relative to one another, said means for mounting including a first frame removably connected to and projecting vertically upwardly from the forward pontoon, a second frame removably connected to and projecting vertically upwardly from the rearward pontoon, said first frame including a seat for positioning a user relative to the rearward pontoon, and means for connecting the first frame to the second frame such that the first frame may rotate relative to the second frame and from a first position, wherein the pontoons and their respective longitudinal axes are aligned along a primary axis, to a second position, wherein the pontoons are angularly oriented relative to one another and their respective longitudinal axes not aligned, whereby to change the angular orientation of the forward pontoon relative to the rearward pontoon and to steer the watercraft, a drive wheel rotatably connected to said rearward pontoon, said wheel including a plurality of radially extending water engaging blades, and means for rotatably driving the drive wheel, said means for rotatably driving being connected, in part, to said second frame and also to said wheel and rotatably driven by the rider.

According to this invention, the rotatable drive wheel comprises a paddle wheel mounted for rotation about a horizontal axis generally orthogonal (i.e., transverse) to the primary axis. The means for rotatably driving comprises a rotatable user driven pedal, and a sprocket chain or a drive shaft that operably connects the pedal to the paddle wheel.

Further and according to this invention, the rotatable drive wheel comprises a propeller blade mounted for rotation about a horizontal axis aligned with said primary axis, and the means for rotatably driving comprises a rotatable user driven pedal, and a drive shaft assembly operably connected to the pedal and the propeller blade.

The rearward pontoon member includes axially spaced forward and rearward end portions and a pair of laterally spaced sidewalls. In an aspect of this invention, the rearward pontoon is provided with a pair of buoyant wing members. One wing member extends along and is disposed laterally outwardly from each respective sidewall. The wing members are sufficiently buoyant to inhibit lateral capsizing or tilting movement of the pedalcraft about the primary axis of the pedalcraft.

Desirably, at least one, or both, pontoon member is, at least in part, hollow or solid, or constructed or otherwise formed of specially configured components comprised of a buoyant polyfoam material.

Desirably, the exterior of the pontoon members is provided with a plastic coating or plastic sheeting, wherein to protect the basic body of the pontoon from the forces of water, enhance the strength of the pontoons, and inhibit the pontoon cross-section from torsional twisting during operation.

To enhance the steerability of the watercraft, a keel fin is attached to the bottom surface of the forward pontoon member. The attachment may be fixed or permit removability. Removability of the fin enables the user to modify the turning dynamics of the pontoons.

In addition, the leading end portion of the forward pontoon could be flat, concave, or be V-shaped, relative to the longitudinal axis through the center thereof, wherein to provide a water engaging portion which will enhance the ability of the user to change the direction of the watercraft.

Removability of the frame members from the pontoons enables storage and ease of transportation of the pedalcraft over land.

Accordingly, there is provided watercraft (i.e., a flotation pedalcraft), which enables the user to easily move about on the water and is collapsible to enable transport of the craft on land to another use, or for storage.

The above and other objects, features and advantages of this invention will become apparent from the following description of a preferred embodiment, which is to be considered in combination with the following drawings.

BRIEF DESCRIPTION OF THE DRAWINGS

FIG. 2A is a perspective view looking down at the forward pontoon member, partially in section, showing interior construction of the pontoon member.

FIG. 2B is a perspective view of the water engaging bottom surface of the forward pontoon member, showing a fin for enhancing directional control of this pedalcraft.

FIG. 3 is a top plan view of the rearward pontoon member.

FIG. 4 is a side elevation view of the rearward pontoon member.

FIG. 5 is section view taken along line 5—5 of FIG. 4 showing interior construction of the rearward pontoon member.

FIG. 9A is a perspective view of a water driven pedalcraft according to this invention and a paddle wheel drive system therefor.

FIG. 9B is a partial cut away view of a portion of the paddle wheel drive system of FIG. 9A.

FIG. 10 illustrates another embodiment of a pedal driven watercraft according to this invention.

FIG. 11 illustrates yet another embodiment of a pedal driven watercraft according to this invention.

FIG. 12 illustrates still another embodiment of a pedal driven watercraft according to this invention.

FIGS. 13A and 13B illustrate yet another embodiment of a pedal driven watercraft according to this invention.

DETAILED DESCRIPTION OF THE PREFERRED EMBODIMENTS

Figure 1:
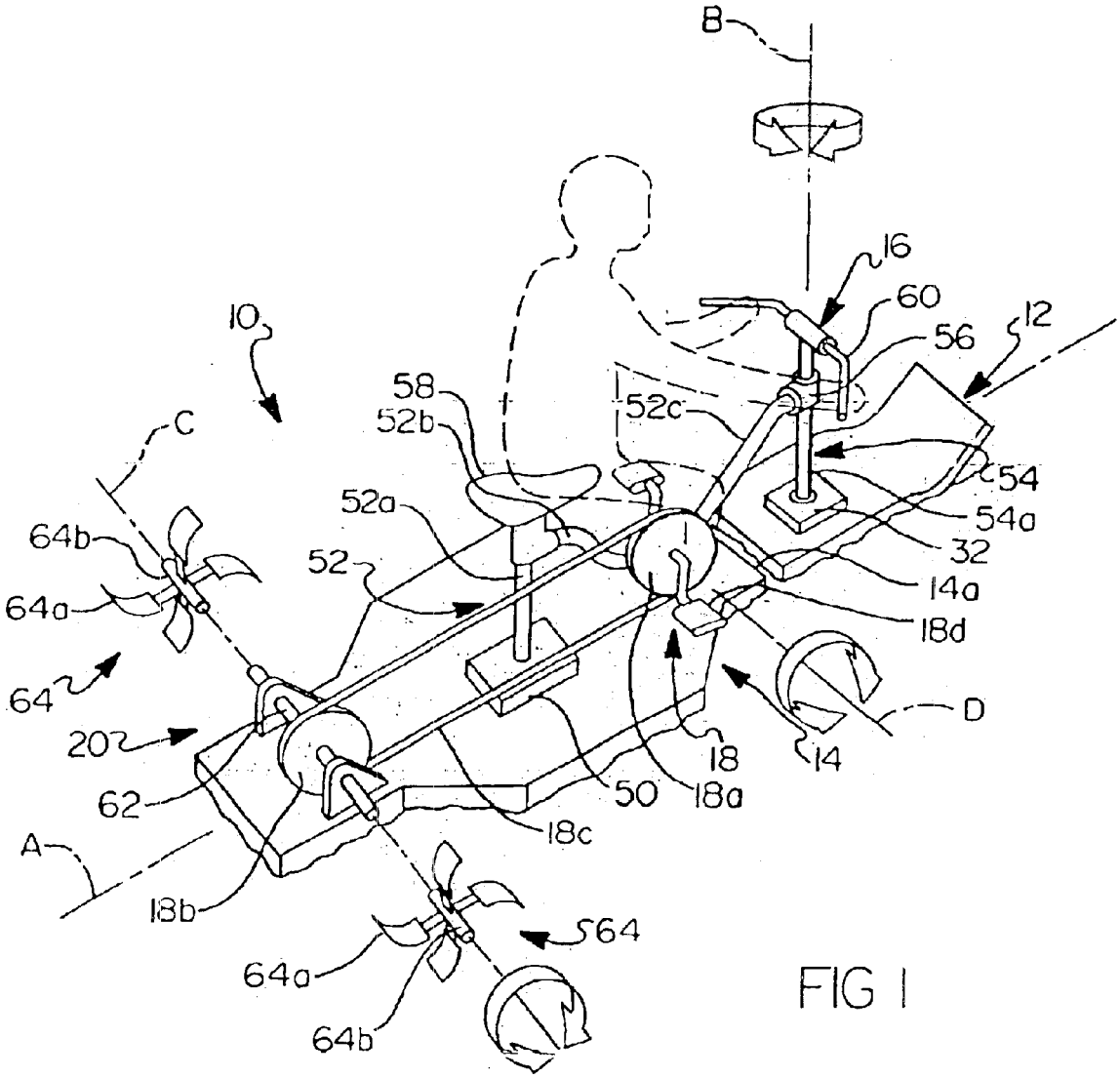
FIG. 1 is a perspective view looking downwardly on a pedalcraft in water and in use, according to a preferred embodiment of this invention, showing details of forward and rearward pontoon members and respective frame portions, and a pedal and propulsion system used to propel the craft in the water.

Turning now to the drawings, and in particular to FIG. 1, there is shown a pedalcraft or pedal operated watercraft 10 which includes a pair of generally rectangularly shaped buoyant floats or pontoon members 12 and 14 and a bicycle framework 16 mounted thereon and supporting a rider (shown in phantom). The rectangular pontoon members 12 and 14 define longitudinal axes which are "in-line", when the user desires to move forwardly, or at an angle to one another, when the user desires to change course. In FIG. 1, the pontoon members are shown in the "in-line" position and the watercraft is going forwardly.

Preferably, the framework is removably mounted to the pontoons to enable the pedalcraft to be disassembled for storage or ground transportation. However, when connected to their respective pontoons, the bicycle frame portions are in fixed relation relative to their respective pontoons. To propel the pedalcraft through the water, a pedal operated drive system 18 is associated with the bicycle framework 16 and a water propulsion system 20 is operably connected to the drive system 18.

A body whose average density is less than that of the water can float partially submerged at the free upper surface of the water. The pedalcraft must not only float but also float upright in a stable equilibrium without capsizing. This requires that normally the line of action of the buoyant force should pass through the center of gravity of the pedalcraft (e.g., the geometric axis through the center of gravity of the pedalcraft should be aligned with a perpendicular to the water). When the pedalcraft heels or tilts, the couple set up by its weight and the buoyant force should be in such a direction to right the pedalcraft.

For example, when the rider mounts the pedalcraft, the rider will step on a lateral step or wing portion of the pontoon structure, the pedalcraft will tilt and the center of gravity of the displaced water will shift away from a vertical through the center of gravity of the pedalcraft (i.e., away from the perpendicular to the water and towards the rider), and the buoyant force will pass through this point. The geometric axis through the center of gravity will be at an angle to the perpendicular. The weight of the pedalcraft and rider and the buoyant force will give rise to a couple in such a direction as to right the pedalcraft. If the line of action of the buoyant force should intersect the center of gravity axis at a point below the center of gravity, the pedalcraft will be unstable and will capsize.

The floats or pontoon members 12 and 14 are dimensioned and/or designed to displace sufficient water by volume to support the pedalcraft 10 and its rider, as well as provide stability against capsizing or tilting. That is, "rolling over" about the primary longitudinal axis of the watercraft.

Shown best in FIG. 2A, the forward float or pontoon member 12 is generally rectangular in shape and includes a rearward end portion 12*a* that is generally planar (or flat) and a forward end portion 12*b* that is generally planar and angled upwardly at an acute angle $\Phi$ relative to the rearward end portion. Preferably, the angle $\Phi$ is between 10° and 25° and more preferably about 20°. The forward pontoon member 12 is used to provide stability during forward propulsion of the pedalcraft 10 and also during steering maneuvers.

The forward pontoon member 12 preferably comprises a thin lower base sheet 22 of polymeric material and having lower and upper surfaces 22*a* and 22*b*, the lower surface 22*a* for engaging the water. Mounted on the upper surface 22*b* are a mounting or support plate 24, a pair of axially elongated hollow cylindrical tubes 26, and an elongated rectangular slab 28 of polymeric material, the tubes 26 and slab 28 being stiffening elements. The tubes 26 extend between the forward and rearward ends of and along the respective lateral sides of the pontoon member 12. The slab 28 is adjacent to the rearward end of the pontoon 12 and extends laterally between the tubes.

A body 30 of polymeric material is disposed on the upper surface 22*b* and in embedding relation about and above the slab 28 and tubes 26. The body 30 increases the buoyancy or ability of the pontoon member 12 to float.

A frame mount or base member 32 is fixedly mounted to the support plate 24 and provided with a cylindrical socket 32*a*. As will be described in greater detail herein below, the socket 24*a* is adapted to removably receive, yet operably secure, an end portion of the framework 16, to the forward pontoon member 12.

According to this preferred embodiment, each of the tubes 26, the slab 28, the base sheet 22, and the body 30 are comprised of a lightweight polymeric material to enhance buoyancy (or the ability of the pontoon to float). For durability, strength, retention of shape, and resistance to deterioration by exposure to the water or hitting objects, the base sheet 22 is preferably comprised of fiberglass. Desirably, the tubes 26 cooperate to stiffen the pontoon and add to the overall rigidity of the structure.

Preferably, in the preferred embodiment, the stiffening tube 26 is about 1½ inch in diameter and comprised of polyvinyl chloride PVC. Although other lightweight materials may be used, e.g. aluminum, a tube of PVC is low in cost, easily to work with, rigid, and readily available in plumbing and similar shops. Further, the cross-section of the tube 26 could be other than circular, such as rectangular or square. This latter configuration would contribute to enabling the pontoon 12 to have a thinner cross-section without sacrifice in rigidity or buoyancy.

The slab 28 and the body 30 of encapsulating material are comprised of a lightweight polyfoam material (e.g. polystyrene, extruded polystyrene, polyurethane, or polyethylene) that is resistant to water attack.

Preferably, the mounting or support plate 24 and the frame mount (or base member) 32 are comprised of wood, although a rigid plastic, or other high density, light weight material is also contemplated. While the forward pontoon 12 is shown as comprising an assembly of several elements, the pontoon could be integrally formed. Further, some of the pieces, such as the support plate 24 and the base member 32, could be integrally formed as one piece and form a subassembly.

Turning to FIGS. 3–5, the rearward float or pontoon member 14 comprises like-shaped upper and lower sheets 34 and 36, and a sidewall 38 extending around the perimeter of the sheets. The sidewall 38 extends vertically between and joins the sheets 34 and 36 together in parallel spaced apart relation to one another whereby to form a closed box-like structure. The sheets 34 and 36 are symmetrical about a central or primary axis "A" and are mirror images of one another. For brevity, only the upper sheet 34 will be described.

The upper sheet 34 is generally flat, planar, of uniform thickness, axially elongated, symmetrical about the central axis, and includes a rectangular-shaped forward end portion 34*a*, a rectangular-shaped rearward end portion 34*b*, and a shaped central portion 34*c* that includes wing portions 34*d* and 34*e* that extend to the right and left of the central axis. The wing portions 34*d* and 34*e* stabilize the pedalcraft and form steps that enables the rider to step onto the pedalcraft and mount the framework 16.

The rearward pontoon 14 is provided with an arrangement for stiffening the box-like structure and includes an axially elongated central stiffener 40 extending along and aligned with the central axis, a plurality of elongated slab members 42 angled to the central stiffener 40, and a pair of end stiffeners 44 and 46 that extend transversely of the central axis. The end stiffeners 44 and 46 are disposed at the opposite respective ends of the central stiffener 40 and adjacent to the forward and rearward ends of the pontoon 14. A pair of mounting blocks 48 and 50 are mounted on the central stiffener 40, each mounting block being provided with a respective central socket 48*a* and 50*a* to enable mounting of the framework 16 thereto, in a manner that will be described in greater detail herein below.

Similar to the construction of the forward pontoon 12 described herein above, the central stiffener 40 and end stiffeners 44 and 46 are comprised of a buoyant material, preferably wood. In some applications, the mounting blocks 48 and 50 are integrally formed with the central stiffener 40, such as being of one-piece construction e.g., molded of a rigid plastic material.

Further, the upper and lower sheets 34 and 36 are preferably comprised of fiberglass to provide strength, resistance to impact and water attack, and durability to support a rider when standing thereon such as for mounting the framework 16. Similarly, the sidewalls 38 would also preferably be comprised of a lightweight buoyant material that resists attack by water and impact, such as fiberglass.

The slab members 42 are comprised of a lightweight buoyant polymeric material, such as polystyrene, polyethylene, or polyurethane. For rigidity, the upper and lower surfaces of the rectangular shaped slabs 42 would be adhered to the interior faces of the upper and lower sheets 34 and 36. Further, the slab members are acutely angled relative to the central stiffener 40 whereby to torsionally reinforce the box-like structure and resist twisting of the pontoon.

While each pontoon 12 and 14 is disclosed as having interior elements, each pontoon could be substantially hollow with the air chamber thus defined being sufficient to support the rider and the pedalcraft on a body of water.

Whether hollow or provided with interior structure, preferably, the exterior of the pontoon member is provided with a plastic coating or plastic sheeting, wherein to protect the basic body of the pontoon from the forces of water, enhance the strength of the pontoons, and inhibit the cross-section of the pontoon from twisting during operation. According to one embodiment, the pontoon members are comprised of polystyrene, a plastic coating is applied to the upper exterior surface of the pontoon, and a plastic sheeting material is applied to the bottom surface of the pontoon.

To enhance the steerability of the watercraft, a fin is removably attached to the bottom surface of the forward pontoon member. In addition, the leading end portion of the forward pontoon is preferably flat, concave, or V-shaped, relative to the longitudinal axis thereof, wherein to provide a water engaging portion which will enhance the ability of the user to change the direction of the watercraft.

To further enhance movement, stability, and steering of the pedalcraft through the water, various portions of the forward pontoon 12 and the rearward pontoon 14 are shaped. The forward pontoon member 12 will be described in greater detail herein below.

As regards the rearward pontoon 14, a portion of the sidewall 38*a* that joins sheets 34 and 36, shown at 38*a*, forms the leading edge of the wing portions 34*c* and 34*d* and angles rearwardly and downwardly from the upper sheet 34. Further, the forward or leading end portion 14*a* of the pontoon 14 is configured to be generally curvilinear.

The framework 16 is removably connected to the pontoons 12 and 14 and includes a rearward frame member 52 and a forward frame member 52. The rearward frame member 52 includes a first, second and third tubular member 52*a*, 52*b*, and 52*c*, the tubular members 52*a* and 52*b* being removably connected in a fixed relation to the sockets 50*a* and 48*a* in the mounting blocks disposed on the rearward pontoon 14. The forward frame member 54 has a tubular member 54*a* removably connected to socket 24*a* in a fixed relation in the support plate 24 disposed on the forward pontoon 12.

A connector 56 is rotatably connected to the tubular member 54*a* and fixedly connected to the third tubular member 52*c* so as to enable relative rotation between the frame members 52 and 54 and about a vertical axis "B" (perpendicular to a horizontal plane defined by the pontoon members). Relative rotation between the frame members operate to rotate the respective pontoon members from a first position wherein the axes of the respective pontoons are axially aligned with the primary axis, and into a second position wherein the axes of the respective pontoons are at an angle to one another. By such rotation, the pontoon members are angularly oriented relative to one another and the pedalcraft direction of movement controlled.

The rearward frame member 52 includes a seat 58 for the rider. The forward frame member 54 includes a handlebar 60 to enable the rider to rotate the forward frame member 54 (and associated forward pontoon 12) relative to the rearward frame member 52 (and associated forward pontoon 14) whereby the pedalcraft 10 may be steered and the desired direction of movement changed or otherwise controlled by the rider.

The pedal operated drive system 18 is operably connected to the rear frame member 52 and includes a forward and rearward sprocket wheel 18*a* and 18*b*, a drive chain 18*c* connecting the sprocket wheels, and a pedal 18*d* operably connected to the sprocket wheel 18*a*. The rearward sprocket wheel 18*b* is mounted on an axle or drive shaft 62 for rotation about an axis "C" transverse to the central longitudinal axis "A" of the pontoon member 14. The forward sprocket wheel 18*a* is mounted on the support 48 for rotation about an axis "D" transverse to the central axis "A".

Additionally, as is conventional and well known, the drive system may comprise a 3-speed gear system as is found on many bicycles The water propulsion system 20 includes a pair of like paddle wheels 64, each being mountable to respective opposite axial ends of the axle or shaft 62. In the embodiment shown, the paddle wheel 64 includes four blades or vanes 64*a* that extend radially outwardly from a central rotor shaft 64*b*, the rotor shaft being fixedly mounted to the drive shaft 62. Preferably, the vanes 64*a* curve radially outwardly and forwardly (i.e., into the direction of rotation) to enhance the engagement of each vane with the water.

Further, to enhance steering control of the pedalcraft, at least one keel fin 65 (FIG. 2) projects from the bottom surface of the forward pontoon 12. As sown in FIG. 2B, the fin 65 has a V-shaped cross-section, extends along the center of the pontoon 12, and tapers upwardly and rearwardly from the bottom surface 22*a*. Preferably, the keel fin 65 is fixed (e.g., integral) but may be retractable or removably positioned.

Additionally, as noted herein above, although the leading end portion of the forward pontoon member 12 illustrated in FIGS. 1, 2A, and 2B is in the form of a generally flat board that is disposed at an acute angle to the trailing end portion of the pontoon, the leading end portion could be other, depending on the steering dynamics desired by the user. For example, in some applications, the water-engaging surface of the leading end portion is V-shaped or concave. Preferably, the V-shaped or concave cross-section is symmetrically centered along the leading end of the pontoon.

In operation, the rider steps onto the upper surface of one wing portion 34*d* or 34*e*. Due to the weight of the rider, that side of the pedalcraft will tend to tilt and displace the water in which placed. Inasmuch as the wing shaped portions of the rearward pontoon 14 are buoyant, an upward buoyant force operates to right or at least inhibit the pedalcraft 10 from overturning upon mounting entry. The rider takes the seat 58, places his feet and hands on the pedals 18*d* and handlebars 60 and rotates the pedals. The drive chain 18*c* transmits rotational action via the axle 62 to the two paddle wheels 64, causing the wheels to rotate and the vanes to be successively rotated into engagement with the water. As a result, the pedalcraft moves in the water. To change the direction of the pedalcraft, the rider rotates the handlebar 60 as desired.

Figure 6:
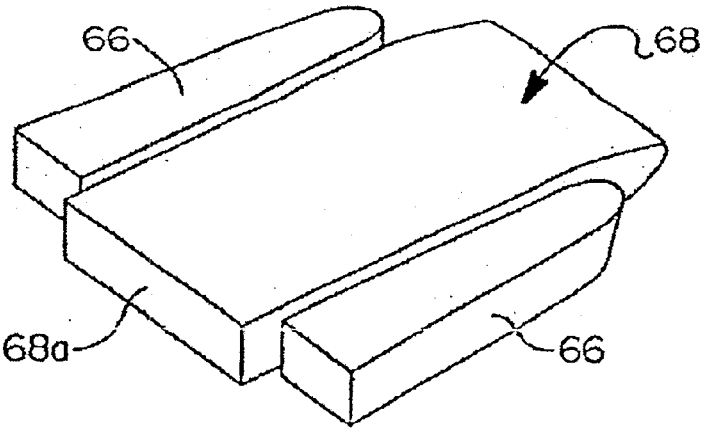
FIG. 6 is a perspective view of an alternative preferred embodiment of a rearward pontoon member.

In some applications, as illustrated in FIG. 6, an additional pontoon or buoyant member 66 may be provided to one or both sides of the rearward pontoon 68. These additional members may be fixedly or detachably connected, rigid and preformed, comprised of lightweight buoyant material, or are inflatable. Desirably, depending on the user and use, the buoyant members act to inhibit or reduce rolling of the pedalcraft and provide stability against rollover.

Additionally, while two paddle wheels 64 are shown, the rearward pontoon 68 could be configured to mount the framework thereupon and at the rearward end 68*a*, mount and operably connect a single paddle wheel (not shown) to the drive system 18.

Further, each paddle wheel could have more (or fewer) than four water engaging blades 64*a*, the blades could be generally flat plates that extend radially from the central rotor, or a plurality of flat plates could be disposed in parallel relation to one another and the rotor axis and arranged angularly to form a drum-like paddle wheel.

Figure 7A:
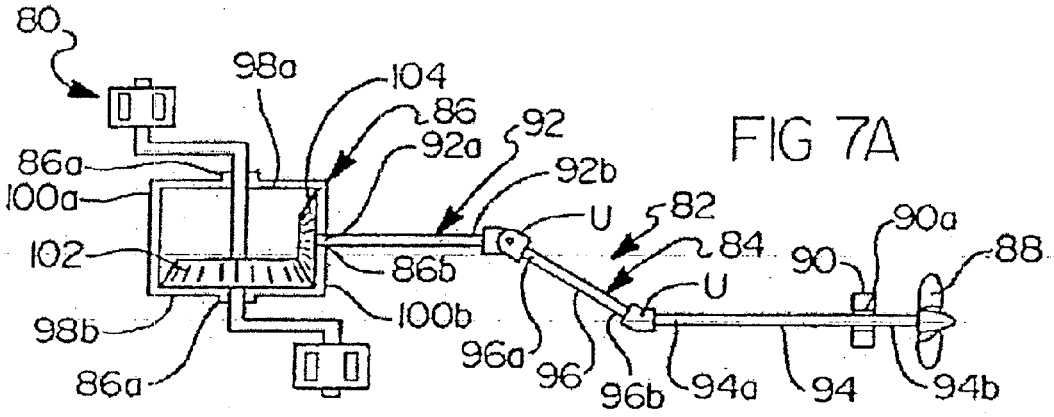
FIGS. 7A and 7B are plan and side views, respectively, of another preferred embodiment, according to this invention, of a water driven pedalcraft and a propeller driven drive system therefor.
Figure 7B:
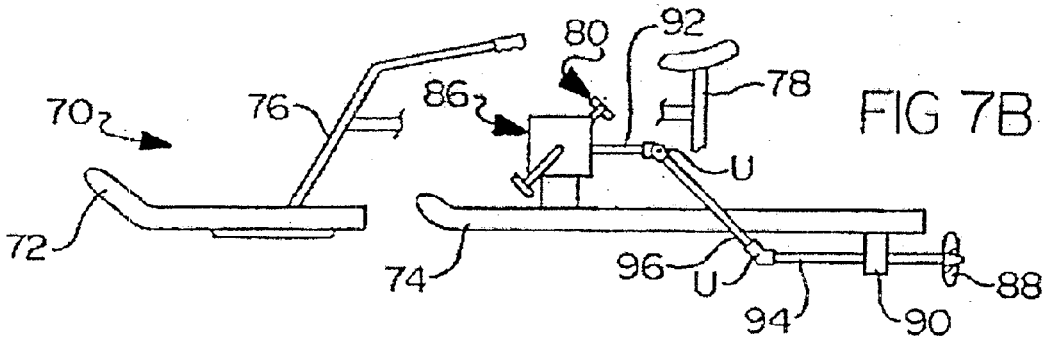

FIGS. 7A and 7B illustrate another water pedalcraft according to this invention, and denoted by the number 70. The water pedalcraft 70 comprises forward and rearward pontoons 72 and 74, forward and rearward frame portions 76 and 78, and a pedal 80 operably connected to the forward frame portion. The frame portions 76 and 78 are removably connected to a respective of the pontoons 72 and 74 and to one another.

Preferably and according to this embodiment, the pedalcraft 70 includes a drive system 82 that includes an axially extending rotatable drive shaft assembly 84, a gear box 86 mounted atop the rearward pontoon 74, a drive propeller 88, and a bearing housing 90 mounted atop the rearward pontoon 74. The drive shaft assembly 84, as described herein below, has forward and rearward end portions, respectively, journalled in the gear box 86 and the bearing housing 90.

The gear box 86 operably connects the forward end portion of the drive shaft assembly 84 to the pedal 80. The bearing housing operably connects the rearward end portion of the drive shaft assembly to the drive propeller 88. In operation, the drive shaft assembly transmits rotational torques from the pedal 80 to the propeller 88 whereby to propel the watercraft and rider on the water.

The drive shaft assembly 84 comprises three shafts, including a forward shaft 92 having opposite ends 92*a* and 92*b*, a rearward shaft 94 having opposite ends 94*a* and 94*b*, and a medial shaft 96 having opposite ends 96*a* and 96*b*. Importantly, the shafts are generally axially extending and interconnected by respective universal joints "U" whereby the enable the shaft to be other than axially aligned. As shown, a first universal joint "U" connects the opposite ends 92*b* and 96*a* of the forward and medial shafts 92 and 96, and a second universal joint "U" connects the opposite ends 96*b* and 94*a* of the medial and rearward shafts 96 and 94. The forward end 92*a* is connected to the gear box 86 and the rearward end 94*b* is connected to the propeller 88.

The gear box 86 comprises a pair of laterally spaced sidewalls 98*a* and 98*b*, a pair of axially spaced endwalls 100*a* and 10*b*, and a pair of bevel gears 102 and 104, the teeth of the bevel gears being operably disposed in intermeshed driving relation with one another. Preferably, the bevel gears have a ratio of between 4:1 and 6:1.

A bearing 86*a* is provided in each sidewall 98*a* and 98*b* to support and journal the pedal 80 for rotation relative to the gear box. A bearing 86*b* is disposed in the rear endwall 10*b* to support and journal the forward end 92*a* of the shaft 92 for rotation relative to the gear box 86.

The bearing housing 90 includes a bearing 90*a* which supports and journals the rearward end 94*b* of the shaft 94 for rotation relative to the pontoon 14.

The bevel gear 102 is larger than the bevel gear 104 and is fixedly connected to the pedal 80 for rotation therewith. The bevel gear 104 is fixedly connected to the forward end 92*a* of the forward shaft 92 for transmitting rotation (i.e., torque) from the pedal 80 to the medial shaft 94, to the rearward shaft 96, and to the propeller 88. As shown in FIG. 7B, the forward shaft 92 angles rearwardly and downwardly and connects the gear box 86 to the medial shaft 96; the medial shaft 96 angles rearwardly and downwardly below the rearward pontoon 74 and connects the forward shaft 92 to the rearward shaft 94; and the rearward shaft 94 extends axially rearwardly, generally in parallel horizontal spaced relation to the bottom surface of the pontoon 74, and connects the rearward shaft 92 to the bearing housing 90.

One skilled in the art would understand that the drive shaft arrangement could be other than shown. For example, a gearing arrangement and a single drive shaft could operably connect the pedal to the propeller. In such arrangement, the single drive shaft could be above or below the pontoon.

The drive propeller 88 is not shown in detail as such would be understood by one skilled in the art. Preferably, the propeller 88 is of the "screw" type and includes a central hub that is fixedly connected to the rearward end 94*b* of the drive shaft end 94 and a plurality of spiral propeller blades that radiate outwardly from the hub. The axis of the hub and drive shaft 94 are preferably generally aligned with the primary axis "A" (or direction of movement) of the water pedalcraft 70.

In operation, the user causes the pedal to rotate, thereby transmitting rotational torques to the propeller. Rotation of the propeller causes the blades to engage the water and propel the pedalcraft 70 and rider across the water.

Figure 8:
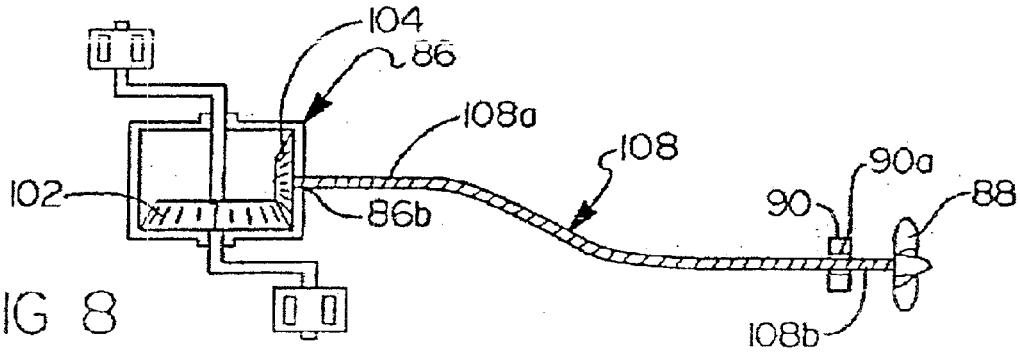
FIG. 8 is a plan view of a preferred embodiment, according to this invention, of a propeller driven drive system for a water driven pedalcraft.

FIG. 8 discloses a water pedalcraft 106 according to this invention that is similar to the pedalcraft 70 but differs in that the drive shaft assembly comprises an axially extending flexible torque transmitting cable 108 having forward and rearward cable ends 108*a* and 108*b*. The forward cable end 108*a* is journalled in the bearing 86*b* of the gear box 86 and operably connected to the small bevel gear 104. The rearward cable end 108*b* is journalled in the bearing 90*a* of the bearing housing 90 and operably connected to drive the propeller 88. In operation, rotational torques from the pedal 80 are transmitted to the large bevel gear 102, to the small bevel gear 104, and to the cable 108, and thereby to rotate the propeller 88.

FIGS. 9A and 9B disclose a pedalcraft 110 according to this invention. In this embodiment, a pair of gear boxes 86 and 112 are mounted atop and at opposite axial end portions of the rearward pontoon 14. The drive assembly includes an axial drive shaft 114 that extends between the gear boxes 86 and 112 and has opposite ends 114*a* and 114*b*, and a pair of paddle wheels 116, which are provided to propel the craft through the water. The forward gear box 86 is as herein above described and differs only in that the small bevel gear 104 is operably connected to the forward end 114*a* of the drive shaft 114.

The paddle wheels 116 are mounted at opposite ends of a common rotor shaft 116*c* and each includes a plurality of water engaging blades or paddles 116*b*. As shown best in FIG. 9B, the rotor shaft 116*c* includes a pair of shaft portions 116*a* and is operably connected to the rearward gear box 112 such that the axis of the shaft is transverse to the direction of movement of the pedalcraft. The shaft portions 116*a* are journalled in respective sidewalls 118*a* and 118*b* of the gearbox 112 to enable rotation of the rotor shaft 116*c*.

The rearward gear box 112 includes the laterally spaced sidewalls 118*a* and 118*b*, a pair of axially spaced forward and rearward endwalls 120*a* and 120*b*, a bearing (not shown) in each respective sidewall 118*a* and 118*b* for supporting and journaling the rotor shaft portion 116*a* of a respective paddle wheel 116, and a bearing (not shown) in the forward endwall 120*a* for supporting and journaling the rearward end 114*b* of the drive shaft 114.

Further, a small bevel gear 122 and a large bevel gear 124 is provided to enable the drive shaft 114 to transmit torque from the pedal 80 operably connected to the forward gear housing 86 to the paddle wheels 116. In this regard, the small bevel gear 122 is fixedly connected to the paddle wheel rotor shaft 116*c*, the large bevel gear 124 is fixedly connected to the rearward end 114*b* of the drive shaft 114, and the teeth of the large and small bevel gears 122 and 124 are intermeshed whereby to transmit torque.

According to the embodiments, shown in FIG. 9B, the rotor shaft 116*c* is one piece, extends through the gear housing, has shaft portions 116*a* journalled in the side walls, and has one shaft portion adjacent to the sidewall 118*a* affixed to the gear 122. Importantly, only one gear 122 is needed to transmit torque from the input shaft 114 via the gear 124.

There has thus been described a novel user powered machine in the form of a watercraft and conveyance which fulfills all of the objects and advantages sought therefor. Many changes, modification, variations and other uses and applications of the subject invention will, however, become apparent to those skilled in the art after considering the specification together with the accompanying drawings and claims.

Illustrative of a modification according to this invention is the water pedalcraft illustrated in FIG. 10 and generally indicated by the reference numeral 130. Similar to the pedalcraft shown and described herein above, the pedalcraft 130 includes the forward pontoon member 12 atop which is mounted the forward frame member 54, and the rearward pontoon member 14 atop which is mounted the rearward frame member 52. A pedal operated drive system 132 includes a pair of spaced sprocket wheel units 134 and 136 connected, respectively, to forward and rearward end portions of the rearward frame member 52, a drive chain 138 drivingly interconnecting the tow wheel units, a pedal 140 drivingly connected to the rearward sprocket wheel unit 136, and a gear box 142 connected to the forward end portion of the frame member 52. Although not shown, as being conventional and known to those in bicycle drive systems, the rearward sprocket wheel unit 136 is in the form of a conventional multi-speed bicycle gear drive, and provided with a chain adjuster and tensioner.

The gear box 142 comprises a generally rectangularly shaped housing or box that, mounts the gears 102 and 104 on respective sidewalls and endwalls, as described herein above, whereby to transmit torque from the pedal 136 to a propeller drive shaft. The propeller drive shaft may be one piece (such as the shaft 114 illustrated in FIG. 9A), flexible (such as the flexible torque transmitting cable 108 illustrated in FIG. 8), or multi-piece and including universal joints (such as the shafts 92, 94, and 96 illustrated in FIGS. 7A and 7B). The propeller shaft is connected to the gear 104, such as shown in FIGS. 9A and 9B.

The forward sprocket wheel unit 136 includes an axial rotor shaft, such as the rotor shaft 116' illustrated in FIG. 9C. The opposite respective ends of the rotor shaft 116' are journalled for rotation in the sidewalls of the housing of the gear box 142, and one end of the rotor shaft is fixed to the gear 102. As described above, the gear teeth of the gears 102 and 104 are interengaged with one another.

According to another aspect of this invention, a water pedalcraft 144 is illustrated in FIG. 11. The pedalcraft 144 is similar to the pedalcraft as shown in FIG. 10 but differs in that the sprocket wheel units 134 and 136 are reversed as to their placement on the spaced portions of the rearward frame member 52.

According to another aspect of this invention, a water pedalcraft 146 is illustrated in FIG. 12. The pedalcraft 146 is similar to the pedalcraft as shown in FIGS. 10 and 11 but differs in that the sprocket wheel units 134 and 136 and the gear box are mounted on the forward end portion of the frame member 52.

According to yet another aspect of this invention, a water pedalcraft 148 is shown in FIGS. 13A and 13B. The pedalcraft 148 includes a single pontoon member 150, a seat 152 mounted atop the pontoon, a drive unit 154, and a steering mechanism 156. The drive unit 154 is in the form of a frame mounted atop the pontoon and positioned in cooperative relation with the seat 152. Similar to that shown and described in connection with FIG. 12, the drive unit includes a pair of generally vertically spaced socket wheel units 134 and 136, a drive chain 138 drivingly interconnecting the two wheel units, a pedal 140 drivingly connected to the sprocket wheel unit 136, and a gear box 142 connected to the frame. The gear box 142 mounts the gears 102 and 1204 and transmits torque from the pedal 136 to a propeller drive shaft (illustrated as shaft 114).

According to this preferred embodiment of the invention, the steering mechanism 156 includes a pair of handles 158L and 158R mounted atop the pontoon and adjacent to the seat 152, a T-bar 160, a pair of force transmitting cables 162, and a triangular shaped keel fin 164. The T-bar 160 comprises a central body member 166 mounted for rotation in the [pontoon near the front end of the pontoon, and a transverse member 166 disposed above the pontoon and having end portions 168L and 168R. The cables 162 are dimensioned to connect the handles 158L and 158R with a respective bar end portion 168L and 168R. The fin 164 is fixedly attached to the lower end portion of the center member 166.

In use, a rider sits on the seat, and operates the pedal to propel the pontoon. A rearward pulling force on one handle, such as the handle 158R, transmits force to the T-bar end 168R via the cable 162 connecting the two together, causing the T-bar 160 to rotate relative to the longitudinal axis of the pontoon. This rotation of the T-bar central member 166 causes the keel fin 164 to rotate, and the pontoon to turn or change direction.

While the present invention has been described with respect to specific embodiments, it will be understood that from the foregoing detailed description and accompanying drawings that various modifications and variations will occur to those skilled in the art. Such modifications and variations are intended to fall within the scope of the appended claims.

What is claimed is:

1. A watercraft, the watercraft including:

a forward and a rearward pontoon, each pontoon being generally planar, longitudinally elongated, having upper and lower surfaces, and sufficiently buoyant to support the watercraft and rider on a body of water, means for mounting the pontoons together in axially spaced, in-line relation to one another and such that the pontoons define a generally horizontally disposed plane for engaging the water and are angularly positionable relative to one another, said means for mounting including a first frame removably connected to and projecting vertically upwardly from the forward pontoon, a second frame removably connected to and projecting vertically upwardly from the rearward pontoon, said second frame including a seat for positioning a user relative to the rearward pontoon, and means for connecting the first frame to the second frame such that the first frame may rotate relative to the second frame and from a first position, wherein the pontoons and their respective longitudinal axes are aligned along a primary axis, to a second position, wherein the pontoons are angularly oriented relative to one another and their respective longitudinal axes are not aligned whereby to change the angular orientation of the forward pontoon relative to the rearward pontoon and to steer the watercraft, a drive wheel rotatably connected to said rearward pontoon, said wheel including a plurality of radially extending water engaging blades, and means for rotatably driving the drive wheel, said means for rotatably driving being connected, in part, to said second frame and also to said drive wheel and rotatably driven by the rider.

2. The watercraft as claimed in claim 1, wherein said rearward pontoon includes forward and rearward end sections, said rotatable drive wheel comprises a paddle wheel mounted at the rearward end section for rotation about a horizontal axis, said horizontal axis being generally orthogonal to the primary axis, and said means for rotatably driving comprises a rotatable user driven pedal at the forward end section, and a sprocket chain that extends between said end sections and operably connects the pedal to the paddle wheel.

3. The watercraft as claimed in claim 1 wherein said rotatable drive wheel comprises a propeller blade mounted for rotation about a horizontal axis aligned with said primary axis, and said means for rotatably driving comprises a rotatable user driven pedal, and a drive shaft assembly operably connecting the pedal and the propeller blade.

4. The watercraft as claimed in claim 1, wherein said rotatable drive wheel comprises a paddle wheel mounted for rotation about a horizontal axis, said horizontal axis being generally orthogonal to the primary axis, and said means for rotatably driving comprises a rotatable user driven pedal, and a drive shaft that operably connects the pedal to the paddle wheel.

5. The watercraft as claimed in claim 1, further comprising inhibiting means for inhibiting lateral capsizing movement of the watercraft about the primary axis.

6. The watercraft as claimed in claim 5, wherein said inhibiting means comprises said rearward pontoon member including axially spaced forward and rearward end portions and first and second sidewalls, said sidewalls being laterally spaced and extending longitudinally between the end portions of said rearward pontoon member, and first and second buoyant wings, said first and second wings extending, respectively, along said first and second sidewalls, said wings being sufficiently buoyant to inhibit capsizing rotation of the watercraft about the primary axis.

7. The watercraft as claimed in claim 1, wherein at least one of the pontoon members is substantially solid.

8. The watercraft as claimed in claim 1, wherein at least one of the pontoon members is substantially hollow.

9. The watercraft as claimed in claim 1, wherein each said pontoon member is generally planar and board-like, each having an upper surface and a lower surface, and further comprising means for controlling the direction of the watercraft, said means for controlling comprising a fin projecting from the lower surface of the forward pontoon.

10. The watercraft as claimed in claim 9, said means for controlling further comprising said forward pontoon having a trailing end portion, spaced from and proximate to the rearward pontoon, and a leading end portion, said leading end being disposed at an acute angle to said trailing end and angled upwardly from to a horizontal plane passing through the forward pontoon.

11. The watercraft as claimed in claim 10, wherein the leading end has a predetermined cross-section arranged along the primary axis of said forward pontoon member, wherein said predetermined cross-section is concave, V-shaped, and flat.

12. The watercraft as claimed in claim 1, wherein each said pontoon comprises a primary body having an exterior surface, and means for protectively covering the exterior surface.

13. The watercraft as claimed in claim 12, wherein said means for protectively covering comprises a sheet of plastic disposed in covering relation with the bottom surface and a coating of plastic disposed in covering relation with the upper surface.

14. The watercraft as claimed in claim 13, wherein said primary body is comprised of a polyfoam material selected from the group consisting of polystyrene, and extruded polystyrene, said coating is comprised of ABS plastic, and said sheet is comprised of fiberglass.

15. A watercraft for use with a standard bicycle frame allowing a rider to have a self-propelled watercraft, said bicycle frame including a first frame including user operated handlebars, a second frame including a seat for supporting the rider, means for connecting the frames together and enabling the first frame to rotate relative to the second frame, and a pedal driven drive, the watercraft comprising:

a forward and a rearward pontoon member, said pontoon members being of sufficient buoyancy to support the rider, and said first and second frames being mounted atop, respectively, the upper surfaces of said forward and rearward pontoon members, and movable by said first and second frames from a first position, wherein the pontoons are in an in-line relation with one another, and a second position, wherein the pontoons are moved into angled relation with one another, a water engaging paddle, said paddle being mounted for rotation to said rearward pontoon member, a paddle driver, said paddle driver connecting said pedal driven drive to said paddle, and a water engaging fin, said fin projecting from the bottom surface of said forward pontoon member and assisting the water engaging dynamics of the forward pontoon.

16. The watercraft as claimed in claim 15, further comprising a pair of buoyant wings, said wings extending along and connected to the lateral sides of the rearward pontoon member wherein to inhibit lateral capsizing rolling movement of the watercraft.

17. The watercraft as claimed in claim 15, wherein the pontoon members are substantially hollow and comprised of a polyfoam material.

18. The watercraft as claimed in claim 15, wherein said rearward pontoon has forward and rearward ends and lateral sides, the sides thereof being centered about a central longitudinal axis extending between the opposite ends thereof, and said water engaging paddle is mounted for rotation about an axis that transverse to said lateral sides and orthogonal to said longitudinal axis.

19. The watercraft as claimed in claim 18, wherein said paddle comprises an axial shaft having opposite ends, and a drive wheel, said shaft being mounted for rotation about said transverse axis, and said paddle driver comprises an endless chain connecting said drive wheel and said pedal driven drive, rotation of said pedal operating to transmit torque through said endless chain to said paddle and said paddle to rotate about said transverse axis.

20. The watercraft as claimed in claim 15, wherein said rearward pontoon has forward and rearward ends and lateral sides, the sides thereof being centered about a central longitudinal axis extending between the opposite ends thereof, and said water engaging paddle is mounted for rotation about an axis parallel to said longitudinal axis.

21. The watercraft as claimed in claim 20, wherein said paddle driver comprises an axially elongated flexible cable, the cable having opposite ends operably connected, respectively, to said paddle and said pedal driven drive, rotation of said pedal operating to transmit torque through said cable to said paddle and said paddle to rotate.

22. The watercraft as claimed in claim 20, wherein said paddle driver comprises a first and a second drive shaft, said shafts being axially elongated and having opposite ends, and a universal joint coupling respective ends of the two drive shafts together, the other respective ends of the drive shafts being connected, respectively, to said paddle and said pedal driven drive, rotation of said pedal operating to transmit torque through said cable to said paddle and said paddle to rotate about said longitudinal axis.

* * * * *